United States Patent [19]

Sung

[11] 4,282,007

[45] Aug. 4, 1981

[54] NOVEL FUEL COMPOSITION CONTAINING ALCOHOL

[75] Inventor: Rodney L. Sung, Fishkill, N.Y.

[73] Assignee: Texaco Inc., White Plains, N.Y.

[21] Appl. No.: 189,528

[22] Filed: Sep. 22, 1980

[51] Int. Cl.[3] ..... C10L 1/22; C10L 1/18

[52] U.S. Cl. ..... 44/53; 44/56; 44/63; 252/390; 252/394; 548/255; 548/268

[58] Field of Search ..... 44/53, 56, 63; 252/390, 252/394; 548/255, 268

[56] References Cited

U.S. PATENT DOCUMENTS

| | | | |
|---|---|---|---|
| 3,897,351 | 7/1975 | Davis et al. | 252/390 |
| 4,148,605 | 4/1979 | Andress, Jr. | 44/63 |
| 4,153,564 | 5/1979 | Chubnik | 44/63 |

*Primary Examiner*—Winston A. Douglas
*Assistant Examiner*—J. V. Howard
*Attorney, Agent, or Firm*—Carl G. Ries; Robert A. Kulason; Carl G. Seutter

[57] ABSTRACT

A novel fuel composition contains ethanol or gasohol plus, as a corrosion inhibitor, a reaction product of aminotriazole and polyisobutenyl succinic acid anhydride.

19 Claims, No Drawings

NOVEL FUEL COMPOSITION CONTAINING ALCOHOL

FIELD OF THE INVENTION

This invention relates to a fuel composition for internal combustion engines particularly characterized by corrosion inhibition.

BACKGROUND OF THE INVENTION

As is well known to those skilled in the art, fuel compositions typified by gasohol and alcohols which are to be considered for commercial use must possess low corrosion activity; and this may be effected by addition thereto of various corrosion inhibition systems. It is an object of this invention to provide a fuel composition for internal combustion engines particularly characterized by corrosion inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline in amount of 0–50 volumes per volume of alcohol; and (b) a minor corrosion inhibiting amount of, as a corrosion inhibiting agent, a reaction product of (i) $C_{15}$–$C_{30}$ hydrocarbyl succinic and anhydride and (ii) aminotriazole.

DESCRIPTION OF THE INVENTION

The fuel for internal combustion engines which may be treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixtures of methanol-ethanol, etc. Commercially available mixtures may be employed. Illustrative of one such commercially available mixture may be that having the following typical analysis:

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute ethanol.

The fuels to be treated by the process of this invention may be substantially anhydrous i.e. they contain less than about 0.3 v % water; typically they may contain 0.001 v %–0.005 v %, say about 0.004 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the fuel a minor corrosion inhibiting amount of, as a corrosion inhibiting agent, a reaction product of an aminotriazole and a $C_{15}$–$C_{30}$ hydrocarbyl succinic acid anhydride.

The aminotriazoles which may be employed may be 3-amino-1H-1,2,4-triazole (I), 4-amino-1,2,4-triazole (II), and 5-amino-1H-1,2,4-triazole (III):

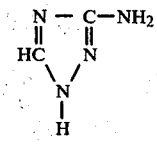

(I)

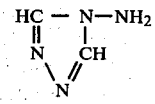

(II)

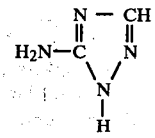

(III)

The preferred of these is 3-amino-1H-1,2,4-triazole.

The $C_{15}$–$C_{30}$ hydrocarbyl succinic acid anhydride reactant may be prepared by the reaction of a maleic acid anhydride with a $C_{15}$–$C_{30}$ polyolefin oligomer. The olefin oligomer or polyolefin reactant may typically be an oligomer of a $C_2$–$C_8$ olefin having a molecular weight $\overline{M}_n$ of 250–30,000, preferably 300–3000, say 300–1400. Preferred oligomers may be polyisobutylenes, more preferably polyisobutylene of $\overline{M}_n$ of 250–5000, preferably 300–3000, say 335.

The mole ratio of anhydride to olefin in the reaction mixture may be 1.0–1.2:1, preferably 1.0–1.1:1, say 1:1.

Reaction between the polyolefin and the typical unsaturated aliphatic dicarboxylic acid anhydride to form the desired product alkenyl saturated aliphatic dicarboxylic acid anhydride may be carried out at 150° C.–300° C. preferably about 210° C.–245° C., say about 245° C. for 2–10, preferably 4–10, say 6 hours at autogenous pressure in batch operation or at 150° C.–300° C., preferably 210° C.–245° C., say about 245° C. for 1–3 hours in a continuous process.

Reaction is typically carried out in the presence of catalyst—commonly 5–200 ppm (based on polyolefin) of 1,3-dibromo-5,5-dimethylhydantoin.

The product may be recovered by distillation of unreacted anhydride followed by filtration of the reaction product.

The so-prepared $C_{15}$–$C_{30}$ hydrocarbyl succinic acid anhydride, preferably polyisobutenyl ($\overline{M}_n$ of 335) succinic acid anhydride, may be reacted with 1.0–1.2 moles, preferably 1.0–1.1 moles (per mole of anhydride) of aminotriazole, preferably 3-amino-1H-1,2,4-triazole. Preferably reaction is carried out in a solvent which is compatible with the fuel composition in which the product is to be used such as an aromatic or aliphatic hydrocarbon typified by benzene, toluene, pentane, heptane, isooctane, etc.

Reaction may be carried out in the absence of catalyst at room temperature of say 20° C. to 150° C., preferably 50 C.–100° C. In the preferred embodiment, the reaction is carried out at the reflux temperature of the solvent. At the end of the reaction period of 12–48 hours, say 36 hours, the reaction mixture may be cooled and used as is; it is however preferably filtered hot and stripped of solvent.

When the mole ratio of triazole to anhydride is 1.0–1.2;1, preferably 1.0–1.1, say 1:1 (theoretically 1:1), the product may be the amide-acid or the imide. When the mole ratio of triazole to anhydride is 2.0–2.2:1, preferably 2.0–2.1:1, say 2:1, the product may be the diamide. The former is the preferred product, referred to as the imide for convenience.

Preferred reaction products may be those obtained by the reaction of:

A. one g. mole of polyisobutenyl ($\overline{M}_n$ 335) succinic acid anhydride and 1 g. mole of 3-amino-1H-1,2,4-triazole in 1200 parts of solvent xylene after refluxing at 140° C. for 6 hours, filtering and solvent-stripping.

B. one g. mole of polyisobutenyl ($\overline{M}_n$ 1290) succinic acid anhydride and 1 g. mole of 3-amino-1H-1,2,4- triazole in 1200 parts of solvent xylene after refluxing at 140° C. for 6 hours, filtering and solvent-stripping.

C. one g. mole of polyisobutenyl ($\overline{M}_n$ 1290) succinic acid anhydride and 1 g. mole of 4-amino-1,2,4-triazole in 1200 parts of solvent xylene after refluxing at 140° C. for 6 hours, filtering and solvent-stripping.

D. one g. mole of polyisobutenyl ($\overline{M}_n$ 1290) succinic acid anhydride and 1 g. mole of 5-amino-1H-1,2,4-triazole in 1200 parts of solvent xylene after refluxing at 140° C. for 6 hours, filtering and solvent-stripping.

The so prepared rust and corrosion inhibitors may be added to a fuel in minor corrosion-inhibiting amount of 0.25–25, preferably 1–20 PTB, more preferably 1–5 PTB, say 2 PTB. (PTB stands for pounds of additive per thousand barrels of fuel). Alternatively expressed, the inhibitor may be added in amount of 0.0001–0.01 w %, preferably 0.004–0.008 w %, more preferably 0.0004–0.002 w %, say 0.008 w %. Larger amounts may be employed, but may not be necessary.

It is a feature of this invention that the fuel composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 110 ml of the test liquid in a 4 ounce bottle for 15 minutes at room temperature of 20° C. 20 ml of the test liquid is poured off and replaced with 20 ml of distilled water. The bottle is shaken as the sample is maintained for 3 hours at 90° F. The percent rust on the strip is determined visually. A second reading is taken after 40 hours.

The inhibited fuels of this invention, after 40 hours of ISCT generally show a Rust and Corrosion rating below about 2-3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known to me of practicing the process of this invention, there is added to 96 parts of the anhydrous alcohol composition of Table I, 4 parts of distilled water and 7.68 ppm (corresponding to 2 PTB) of, as additive, the reaction product of equimolar amounts of (i) 3-amino-1H-1,2,4-triazole and (ii) polyisobutenyl ($\overline{M}_n$ of 335, corresponding to about a $C_{24}$ chain length) succinic acid anhydride, the latter having been prepared by reaction of polyisobutylene and maleic acid anhydride. The reaction mixture is refluxed for 6 hours at 140° C. in an excess of xylene solvent; the solvent is stripped off after completion of reaction.

The resulting fuel composition was tested in the ISCT; and the Rust and Corrosion Rating determined after 40 hours.

EXAMPLE II*

The procedure of Example I was duplicated except that the additive was the reaction product of 3-amino-1H-1,2,4-triazole and polyisopropenyl ($\overline{M}_n$ of 168, corresponding to a $C_{12}$ chain) succinic acid anhydride, the latter having been prepared by reaction of polypropylene and maleic acid anhydride.

The fuel composition was tested in the ISCT.

* designates a control example; all others are experimental examples.

EXAMPLE III*

The procedure of Examples I–II was duplicated except that the additive was 5-amino-1H-1,2,4-triazole.

EXAMPLE IV*

The procedure of Examples I-II-III was duplicated except that the additive was 76 PTB of a prior art standard commercial rust and corrosion inhibitor.

EXAMPLE V*

The procedure of Examples I–IV was duplicated except that no additive was present—only 4 parts of distilled water.

The results of the Iron Strip Corrosion Test were as follows:

TABLE

| Example | 40 hour Rust & Corrosion Rating |
|---|---|
| I | trace - 1% |
| II* | 40% |
| III* | 20% |
| IV* | 50% |
| V* | 50% |

From the above table, it will be apparent that the system of Example I, prepared in accordance with practice of the process of this invention, showed less than about 1% rust and corrosion. Control Examples II–V showed 20%–50% rust and corrosion which is unsatisfactory.

It is noted that if the additive is made from a higher molecular weight polypropylene than that used in Example II*, eg one having a chain length of eg $C_{15}$, the results will be comparable to those attained with Example I.

Results comparable to those of Example I may be obtained if the additive is formed from polyisobutylene ($\overline{M}_n$ of 335) and the following acid anhydride (rather than from maleic acid):

| Example | Additive -Anhydride |
|---|---|
| VI | citraconic |
| VII | itaconic |
| VIII | ethylmaleic |
| IX | chloromaleic |

Results comparable to those of Example I may be obtained if the aminotriazole reactant is:

| Example | Reactant |
|---|---|
| X | 4-amino-1,2,4-triazole |
| XI | 5-amino-1H-1,2,4-triazole |
| XII | 3-amino-1H-1,2,4-triazole, but in mole ratio of 2:1 with respect to the polyisobutenyl succinic acid anhydride |

Results comparable to those of Example I may be obtained if the fuel is as follows:

| Example | Fuel |
|---|---|
| XIII | Gasohol containing 90 v % gasoline and 10 v % absolute ethanol |
| XIV | absolute ethanol |
| XV | absolute methanol |

Although this invention has been illustrated by reference to specific embodiments, it will be apparent to those skilled in the art that various changes and modifications may be made which clearly fall within the scope of this invention.

I claim:

1. A fuel composition for internal combustion engines comprising (a) a major portion of a fuel containing (i) at least one alcohol selected from the group consisting of ethanol and methanol and (ii) gasoline in amount of 0–50 volumes per volume of alcohol; and (b) a minor corrosion inhibiting amount of, as a corrosion inhibiting agent, a reaction product of (i) $C_{15}$–$C_{30}$ hydrocarbyl succinic acid anhydride and (ii) aminotriazole.

2. A fuel composition for internal combustion engines as claimed in claim 1 wherein said fuel is an alcohol.

3. A fuel composition for internal combustion engines as claimed in claim 1 wherein said fuel is methanol.

4. A fuel composition for internal combustion engines as claimed in claim 1 wherein said fuel is ethanol.

5. A fuel composition for internal combustion engines as claimed in claim 1 wherein said fuel is a commercial ethanol.

6. A fuel composition for internal combustion engines as claimed in claim 1 wherein said fuel is a commercial ethanol containing acid.

7. A fuel composition for internal combustion engines as claimed in claim 1 wherein said fuel is a commercial ethanol containing acetic acid.

8. A fuel composition for internal combustion engines as claimed in claim 1 wherein said fuel is a gasohol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v % water.

11. A fuel composition for internal combustion engines as claimed in claim 1 wherein said aminotrazole is 3-amino-1H-1,2,4-triazole.

12. A fuel composition for internal combustion engines as claimed in claim 1 wherein said aminotriazole is 4-amino-4H-1,2,4-triazole.

13. A fuel composition for internal combustion engines as claimed in claim 1 wherein said aminotriazole is 5-amino-1H-1,2,4-triazole.

14. A fuel composition for internal combustion engines as claimed in claim 1 wherein said hydrocarbyl succinic anhydride is polyisobutenyl succinic anhydride.

15. A fuel composition for internal combustion engines as claimed in claim 1 wherein said reaction product is present in minor corrosion inhibiting amount of 0.0001 w %–0.01 w % of said fuel composition.

16. A fuel composition for internal combustion engines comprising (a) a major portion of a fuel containing absolute ethanol; and (b) a minor corrosion inhibiting amount of, as a corrosion inhibiting agent, a reaction product of polyisobutenyl ($\overline{M}_n$ of 300–3000) succinic acid anhydride and 3-aminotriazole.

17. A fuel composition for internal combustion engines as claimed in claim 16 wherein said molecular weight $\overline{M}_n$ is 300–1400.

18. A fuel composition for internal combustion engines as claimed in claim 16 wherein said reaction product is present in minor corrosion inhibiting amount of 0.0001 w %–0.001 w % of said fuel composition.

19. The method which comprises adding to a fuel containing (i) at least one alcohol selected from the group consisting of ethanol and methanol and (ii) gasoline in amount of 0–50 volumes per volume of alcohol, a minor corrosion inhibiting amount of, as a corrosion inhibiting agent, a reaction product of (i) $C_{15}$–$C_{30}$ hydrocarbyl succinic acid anhydride and (iii) aminotriazole.

* * * * *

UNITED STATES PATENT AND TRADEMARK OFFICE

CERTIFICATE OF CORRECTION

PATENT NO. : 4,282,007

DATED : August 4, 1981

INVENTOR(S) : Rodney L. Sung

It is certified that error appears in the above—identified patent and that said Letters Patent is hereby corrected as shown below:

Claim 12, line 3 cancel "4-amino-1H-1,2,4-triazole" substitute therefor -- 4-amino-1,2,4-triazole --.

Signed and Sealed this

*Second* Day of *March 1982*

[SEAL]

*Attest:*

GERALD J. MOSSINGHOFF

*Attesting Officer* *Commissioner of Patents and Trademarks*